US005700095A

United States Patent [19]

Sugiyama

[11] Patent Number: 5,700,095

[45] Date of Patent: Dec. 23, 1997

[54] PRINT GAP ADJUSTOR IN A SERIAL PRINTER

[75] Inventor: Wataru Sugiyama, Nagoya, Japan

[73] Assignee: Brother Kogyo Kabushiki Kaisha, Nagoya, Japan

[21] Appl. No.: 579,157

[22] Filed: Dec. 27, 1995

[30] Foreign Application Priority Data

Feb. 3, 1995 [JP] Japan ..... 7-039032

[51] Int. Cl.[6] ..... B41J 25/308

[52] U.S. Cl. ..... 400/55; 400/59

[58] Field of Search ..... 400/55, 56, 57, 400/58, 59, 352, 354, 354.1, 354.2, 354.3, 355, 356, 357, 358

[56] References Cited

U.S. PATENT DOCUMENTS

| | | | |
|---|---|---|---|
| 4,086,997 | 5/1978 | Wu | 400/59 |
| 4,365,900 | 12/1982 | Gottsmann et al. | 400/57 |
| 4,676,675 | 6/1987 | Suzuki et al. | 400/59 |
| 5,156,464 | 10/1992 | Sakai | 400/56 |

FOREIGN PATENT DOCUMENTS

| | | | |
|---|---|---|---|
| 28 38 627 | 3/1979 | Germany | 400/55 |
| 56-049286 | 5/1981 | Japan | 400/59 |
| 56-117677 | 9/1981 | Japan | 400/56 |
| 61-154869 | 7/1986 | Japan | 400/55 |
| 63-182169 | 7/1988 | Japan | 400/55 |
| 2-243375 | 9/1990 | Japan | 400/55 |
| 3-133678 | 6/1991 | Japan | 400/55 |
| 3-161381 | 7/1991 | Japan | 400/56 |

*Primary Examiner*—David A. Wiecking
*Attorney, Agent, or Firm*—Oliff & Berridge

[57] ABSTRACT

A decentering collar to hold and rotate a carriage by a fixed decentering amount. The position the carriage is moved relatively by rotation of the decentering collar to one of two positions having the same height with respect to the center of rotation of the decentering collar in the direction of the print paper feed. From these two positions, a position can be selected by operation of the adjustment lever that is appropriate for the thickness of the print paper.

18 Claims, 6 Drawing Sheets

PRINT GAP ADJUSTOR IN A SERIAL PRINTER

BACKGROUND OF THE INVENTION

1. Field of the Invention

The invention relates to a printer, in particular, to a technology for adjusting the interval between the print surface of the print paper and the print head during printing on the print surface of the print paper.

2. Description of Related Art

When the thickness of the print paper changes in a printer, the print quality becomes uneven due to the change in the interval between the print surface of the print paper and the print head. To compensate, a printer is known wherein a mechanism is provided to adjust the interval between the print surface of the print paper and the print head by changing the posture of the print head so that the interval between the print surface of the print paper and the print head is kept uniform. Hereafter, adjustment of the interval between the print surface of the print paper and the print head in this type of printer will be described with reference to FIGS. 4–6.

FIG. 4(*a*) is a side view showing the positional relationship between the print paper 34, print head 35 and carriage 33 during printing on the surface of a print paper having a normal thickness; FIG. 4(*b*) shows a positional relationship between an angle adjustment lever 41 and a guide plate 42 (support member) as shown in FIG. 4(*a*); FIG. 5(*a*) is a side view showing a positional relationship between the print paper 34, print head 35 and carriage 33 during printing on the surface of a print paper with a thicker-than-normal thickness; FIG. 5(*b*) shows a positional relationship between the angle adjustment lever 41 and the guide plate 42 (support member) as shown in FIG. 5(*a*); and FIG. 6 is a magnified side view of the print head unit 35 of FIG. 5(*a*).

The printer 31 comprises the carriage 33 to hold the ink cartridge 32 which stores printing ink and the print head 35 for printing on the print surface of the print paper 34. The carriage 33 is supported by the guide shaft (guide member) 36 and moves linearly back and forth along the print line on the print paper 34 while facing the print paper 34. The angle adjustment lever 41 is provided in the back part of the carriage 33 abutting the guide plate 42 and supporting the carriage 33 in such manner that the posture of the carriage 33 is adjusted by rotating the angle of adjustment lever 41.

In the printer 31 having the structure described above, the angle adjustment lever 41 abuts the guide plate 42 vertically, or at a right angle, when printing on the print surface of the print paper 34 with normal thickness. In this state, the print head 35 is kept parallel to the print paper 34 to maintain a predetermined amount of interval between the nozzle surface of the print head 35 and the print surface of the print paper 34, as shown in FIGS. 4(*a*) and 4(*b*). In order to print on the print surface of a print paper 34 having a thicker-than-normal thickness, the angle adjustment lever 41 is rotated clockwise (as shown in FIG. 5(*b*)). This causes the carriage 33 to pivot about guide shaft 36 and changes the posture of the print head 35 as the interval between the nozzle surface of the print head 35 and the print surface of the print paper 34 expands in such manner that the interval is as shown in FIG. 5(*a*). In this manner, the interval between the print surface of the print paper 34 and the print head 35 is adjusted even when printing on the print surface of the print paper 34 having a thicker-than-normal thickness.

However, in printing on the print surface of the print paper 34 having a thicker-than-normal thickness in the printer 31 described above, the carriage 33 is made to pivot amount the guide shaft 36, causing the posture of the print head 35 to tilt to produce the adjustment in the interval between the print paper 34 and the print head 35. This results in an unequal distance between each part of the surface of the print head 35 facing the print paper 34 and the print surface of the print paper 34 (FIG. 6). The result is a failure to achieve highly accurate printing, thus making it difficult to obtain uniform print quality.

There are also wire dot matrix printers having print head position controlling mechanisms as described above, however, they too are unable to perform high quality printing. Examples of this type of printer are disclosed in U.S. Pat. Nos. 4,676,675 and 5,156,464, which are expressly incorporated by reference herein.

SUMMARY OF THE INVENTION

An object of the invention is to provide a printer capable of producing uniform printing quality by eliminating tilting of the print head relative to the print surface of the printing paper when adjusting the interval between the print surface of the print paper and the print head.

In order to achieve the purpose described above, the printer of the invention is capable of adjusting the interval between the print paper and the print head for printing on the print paper according to the thickness of the print paper and comprises: a carriage holding the print head and moving linearly back and forth along the print line on the print paper; a guide member to guide the carriage to move linearly back and forth; a decentering collar to be fitted on the external surface of the guide member in such a manner that the collar is allowed to slide and rotate and to hold the carriage such that the carriage is allowed to rotate with the center which is shifted by a predetermined decentering amount with respect to the center of rotation on the external surface of the guide member; and a positioning member to position the decentering collar in at least two rotational positions among various rotational positions of the decentering collar sliding on the external surface of the guide member such that the heights corresponding to the shifted position in the direction of feeding the print paper become the same, wherein adjustment of the interval between the print paper and the print head is enabled by moving the carriage toward or away from the print paper through rotation of the decentering collar around the guide member.

For example, the positioning member is provided in the decentering collar and comprises: an adjustment lever provided in the decentering collar and rotating with the decentering collar; and a position determining member to determine a relative position between the adjustment level and the carriage, wherein the shift amount of the center of rotation to hold the carriage can be determined by the position determining member.

The position determining member can comprise a protrusion and a hole, for example, provided on the surface where the adjustment lever and the carriage face each other in such manner that the protrusion and the hole can mesh with one another.

In a printer structured in the manner described above, the carriage moves toward and away from the print paper by making the decentering collar rotate around the guide member according to the thickness of the print paper, enabling adjustment of the interval between the print surface of the print paper and the print head to maintain a uniform interval, hence a uniform print quality is obtained regardless of the thickness of the print paper.

Moreover, because the decentering collar can be made to rotate differently according to the thickness of the print paper, at least two positions can be selected and established for the height of the decentering position in the direction of the feeding the print paper with respect to the center of the rotation of the decentering collar. Hence, the interval between the print paper and the print head is adjusted according to the thickness of the print paper without changing the posture of the print head. In this case, the distance between each part on the surface of the print head and the print surface of the print paper is held constant. Hence, a decline in the print quality due to tilting of the print head can be eliminated enabling uniform print quality.

Furthermore, because the decentering position of the decentering collar is determined by the protrusion and the hole which can engage with each other, selection and establishment of each of at least two points where the height in the direction of feeding the print paper can be maintained at the decentering position with respect to the center of rotation of the decentering collar.

BRIEF DESCRIPTION OF THE DRAWINGS

A preferred embodiment of the invention will be described in detail with reference to the following figures wherein:

FIG. 3(*b*) shows a second alternative way to retain a carriage in alternative position;

FIG. 4(*b*) shows the positional relationship between the angle adjustment lever and the guide plate of FIG. 4(*a*);

FIG. 5(*b*) shows the positional relationship between the angle adjustment lever and the guide plate of FIG. 5(*a*)

DETAILED DESCRIPTION OF PREFERRED EMBODIMENT

Figure 1:
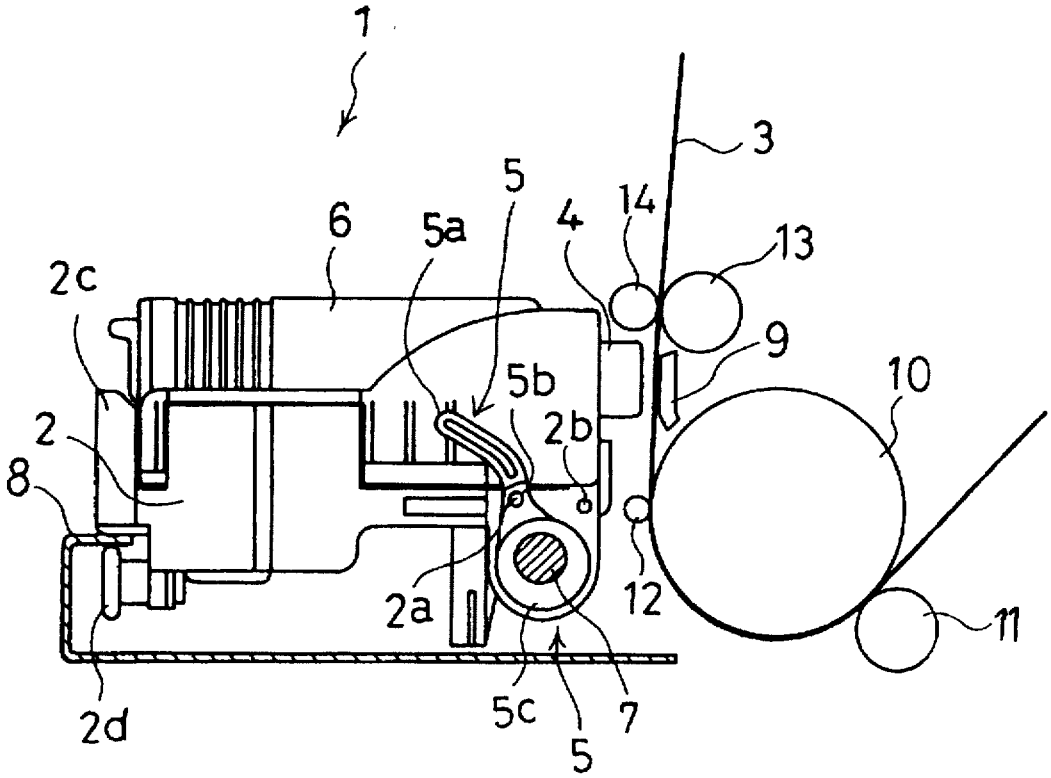
FIG. 1 is a side view showing the positional relationship of the print paper, the print head and the decentering collar for printing on the print surface of the print paper having a normal thickness.
Figure 2:
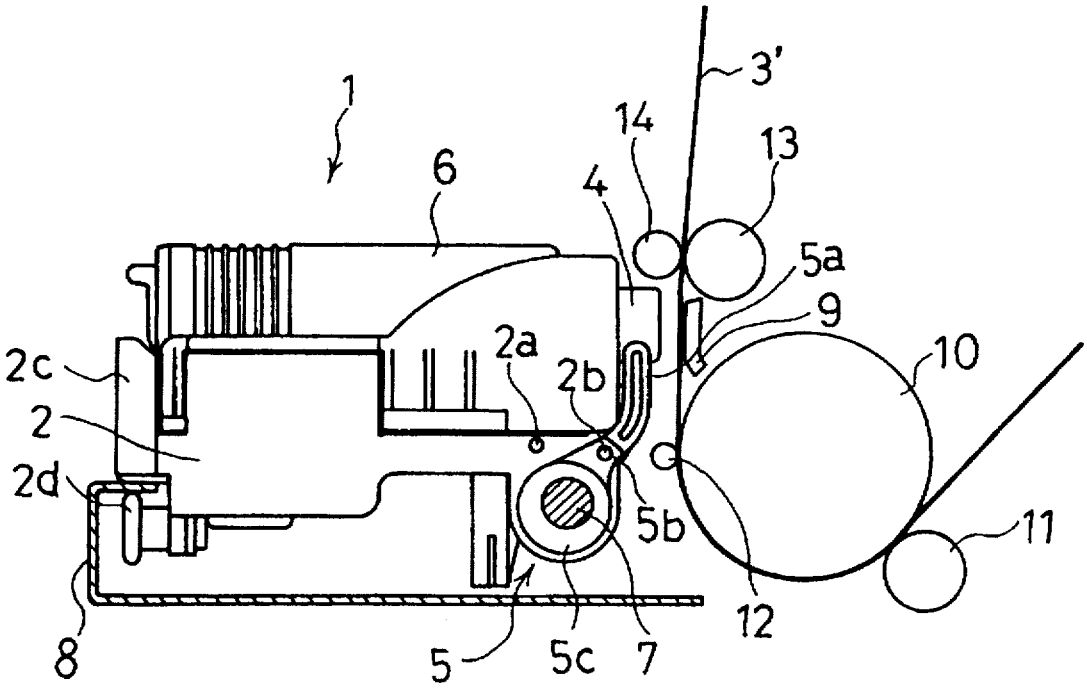
FIG. 2 is a side view showing the positional relationship between the print paper, the print head and the decentering collar for printing on the print paper having a thicker-than-normal thickness.
Figure 3A:
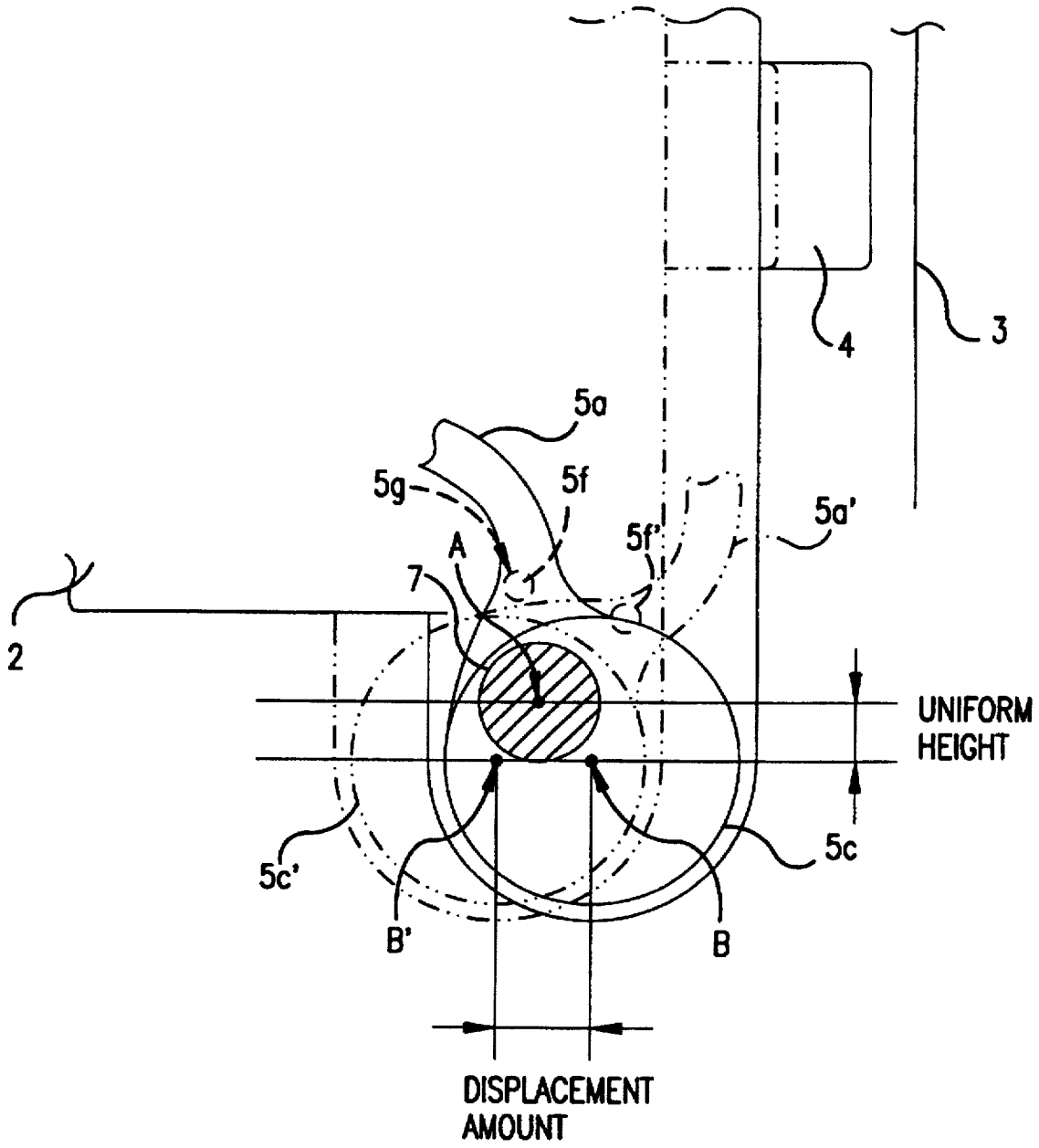
FIG. 3(*a*) shows a first alternative way to retain the carriage in alternative positions.
Figure 3B:
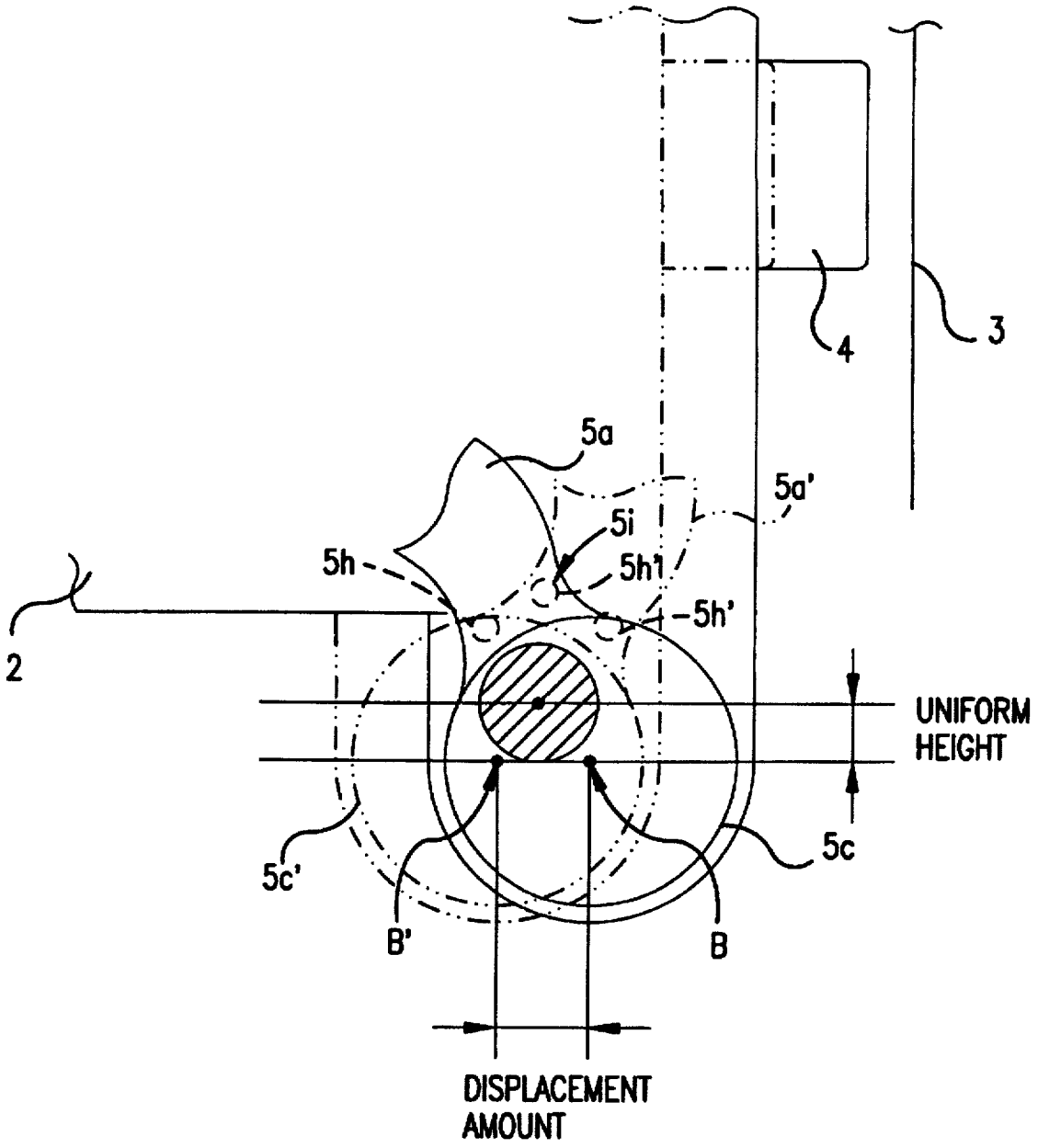
Figure 4A:
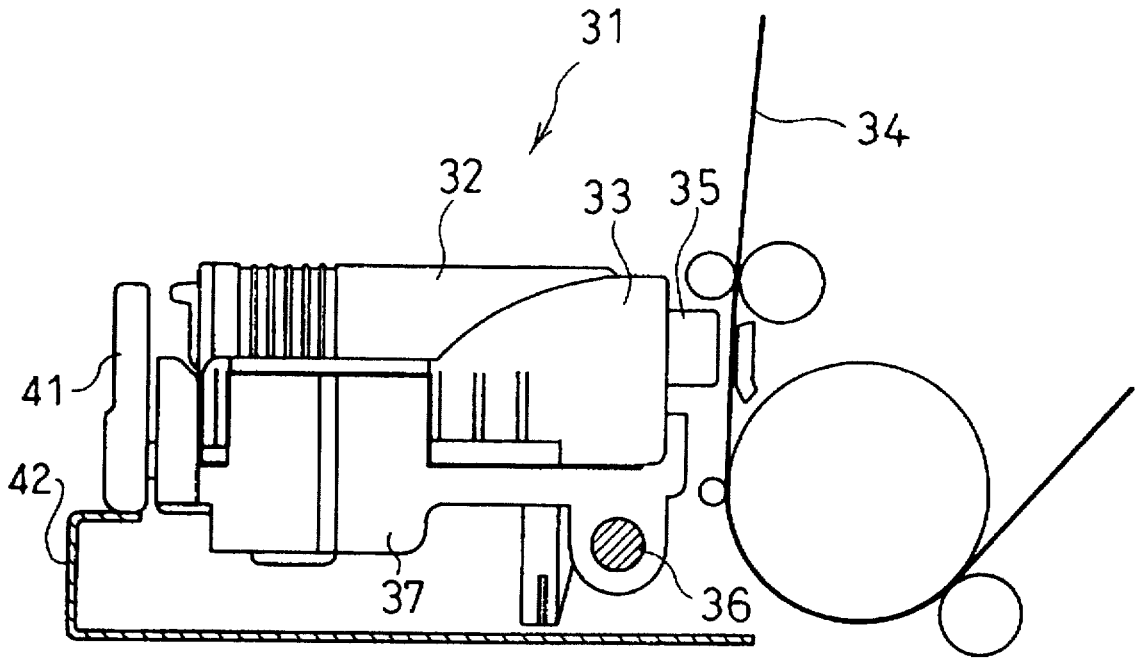
Fig.4A RELATED ART
FIG. 4(*a*) a side view showing the positional relationship between the print head and the carriage and the print paper for printing on print paper of normal thickness using a conventional printer.
Figure 4B:
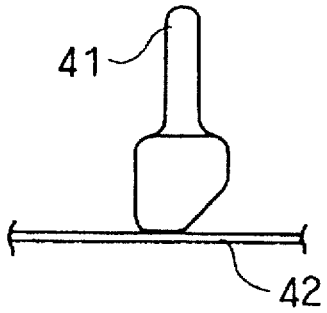
Fig.4B RELATED ART
Figure 5A:
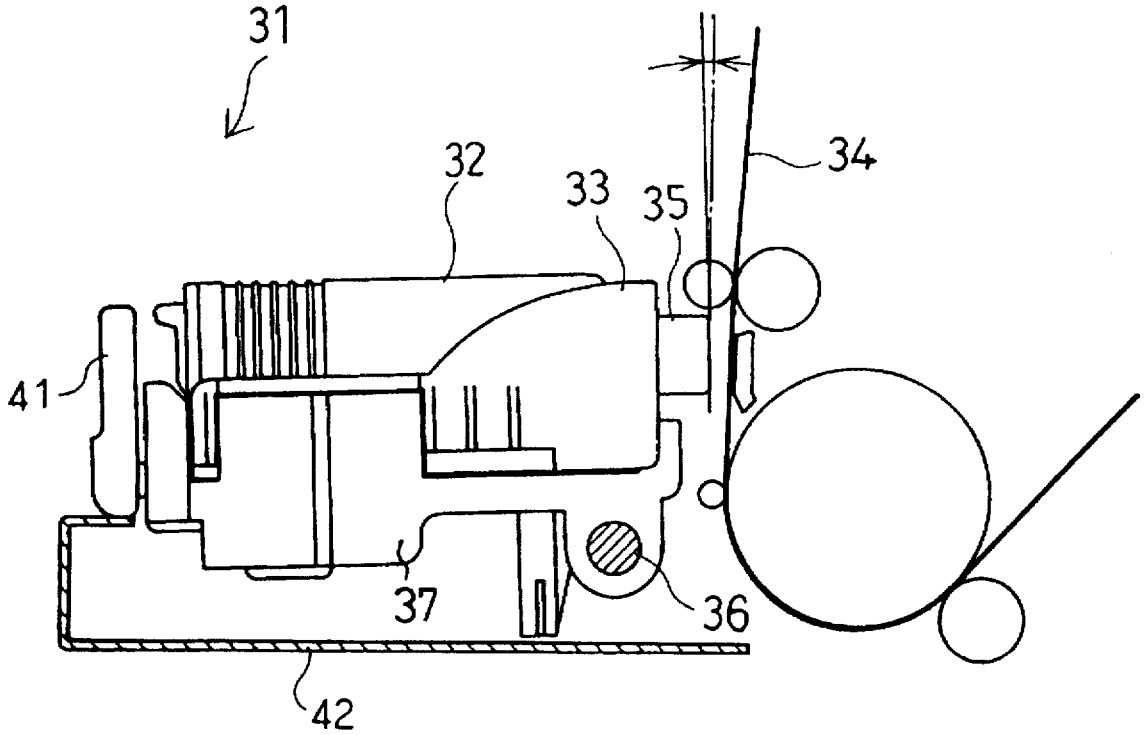
Fig.5A RELATED ART
FIG. 5(*a*) a side view showing the positional relationship between the print head and the carriage and the print paper for printing on the print paper with a thicker-than-normal thickness.
Figure 5B:
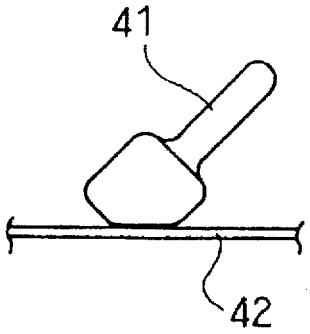
Fig.5B RELATED ART
Figure 6:
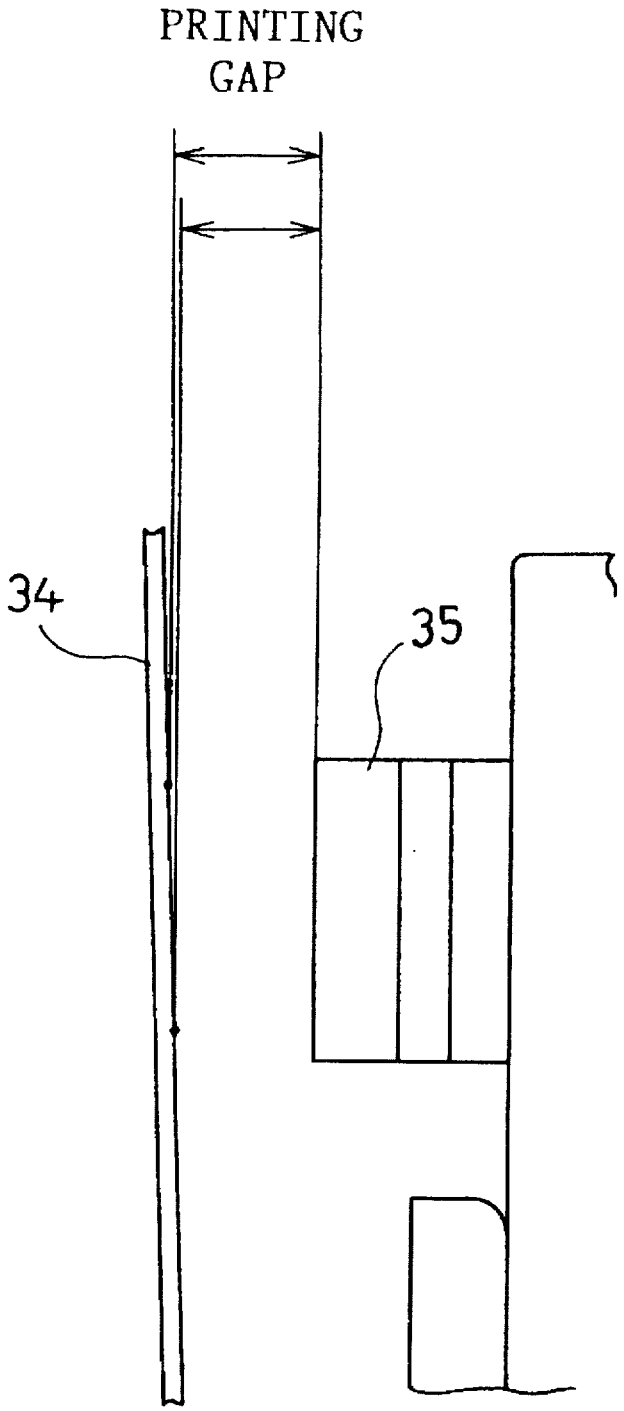
Fig.6 RELATED ART
FIG. 6 is an enlarged side view of the print head unit shown in FIG. 5(*a*).

Hereafter, an embodiment of the invention will be described with reference to the drawings. FIGS. 1 and 2 are side views of an ink-jet type printer of the embodiment of the invention. FIG. 1 shows the positional relationship between the print paper 3, the print head 4 and the decentering collar 5 in printing on the print surface of the print paper 3 with a normal thickness. FIG. 2 shows the positional relationship between the print paper 3', the print head 4 and the decentering collar 5 in printing on the print surface of the print paper 3 with a thicker-than-normal thickness. FIG. 3 is a drawing showing the decentering position of the decentering collar 5 due to rotation and movement of the print head 4 and the carriage 2.

The printer 1 of the invention comprises the carriage 2 which moves (driven by a driving motor, not shown) linearly back and forth along the print line on the print paper facing the print paper 3. The carriage 2 holds a print head 4 which executes printing by ejecting ink onto the surface of the medium being printed. The carriage 2 has the decentering collar 5 which moves the carriage 2 by its rotation. The ink used for printing is stored in an ink cartridge 6 mounted on the carriage 2. The carriage 2 is axially supported by a guide shaft (guide member) 7 which is anchored between the chassis side boards (not shown) in such manner that the carriage 2 moves linearly back and forth and rotates freely. The carriage 2 and the posture of the print head 4 are maintained by the guide plate holding units 2*c*,2*d*, placed in the lower part of the back side of the carriage 2, that hold from both surfaces of the guide plate (holding member) 8 which is anchored between the chassis side boards. A platen 9 is provided on the opposite side of the print surface of the print paper 3 to hold the print paper 3.

A paper feeding roller 10 transports the print paper 3 by rotation. Tension rollers 11,12 are provided adjacent the paper feeding roller 10 to make contact with or to separate from the paper feeding roller 10 and assist in the transport of the print paper 3 by holding the print paper 3 against the paper feeding roller 10. A paper discharge roller 13 and a paper discharge tension roller 14, to discharge the print paper 3, are also provided. The paper feeding roller 10, tension rollers 11,12, paper discharge roller 13, and paper discharge tension roller 14 are supported between the chassis side boards (not shown) so as to be able to rotate freely. A driving mechanism (not shown), that receives the rotation power from the driving motor (not shown), is connected to the paper feeding roller 10 and the paper discharge roller 13.

A cylindrical unit 5*c* is provided on the decentering collar 5 and is fitted (socket joined) to the external surface of the guide shaft 7 to slide and rotate freely. Moreover, the cylindrical unit 5*c* holds the carriage 2 to rotate freely. The decentering collar 5 is formed in such a manner that the center of rotation A of the decentering collar 5, that is, the center of the guide shaft 7 (hereafter, center A) possesses a predetermined decentering amount between the center of rotation B (hereafter, center B) with respect to the carriage 2. Rotation of the decentering collar 5 causes the carriage 2 to move substantially horizontally, that is, toward and away, with respect to the print surface of the print paper 3. In order to properly determine the position of the carriage 2, which moves by the rotation of decentering collar 5, protrusions 2*a*,2*b* are formed on the surface of the carriage 2 adjacent an adjustment lever 5*a* of the decentering collar 5. A hole 5*b* is provided in the adjustment lever 5*a* to engage with the protrusions 2*a*,2*b* to fix the carriage 2 and the adjustment lever 5*a*.

Hereafter, the operation of the printer 1 having the structure described above will be described. In the printer 1, the adjustment lever 5*a* of the decentering collar 5 is rotated according to the thickness of the print paper 3 and the position of the print head 4 is determined by the engagement of the hole 5*b* of the adjustment lever 5 with either protrusion 2*a* or protrusion 2*b* of the carriage 2. When the print paper 3 is transported to the place between paper feeding roller 10 and the tension rollers 11,12 by a paper feeding device (not shown), the carriage 2, which is in the stand-by mode at the home station, that is, at a stand-by position during the intervals between print operations, begins linearly back and forth printing movement driven by the driving motor (not shown). Hence, the print head 4 moves facing the print surface of the print paper 3 maintaining a constant interval with the print paper 3. The print head 4 injects ink particles onto the print surface of the print paper 3 and executes printing opposite the platen 9 positioned between the paper feeding roller 10 and the paper discharge 13. When the print head 4 completes printing over the entire print surface of the print paper 3, the print paper 3 is discharged from the printer 1 by the paper discharge roller 13 and the paper discharge tension roller 14 and the carriage 2 returns to the home station.

Next, the selection and establishment of the positions of the carriage 2 and print head 4, which is positioned by the rotation of the decentering collar 5, will be described. As explained above, the decentering collar 5 is formed in such a manner that the center B possesses a predetermined decentering amount with respect to center A, hence, when the adjustment lever 5*a* is rotated clockwise from the position shown in FIG. 1 to the position shown in FIG. 2, the center B rotates around the center A. The carriage 2, being rotatably held by decentering collar 5, moves with the rotation of the center B by an amount equal to the displacement of the center B around the center A. The positions to which the center B rotates around the center A, that is center B and center B' shown in FIG. 3, have the same height relative to the direction of feed of the print paper 3. The guide plate 8 and the guide plate holding units 2*c*,2*d* are relatively fixed with respect to the direction of feed of the print paper in either of the two positions above (center B,B' in FIG. 3) so that the print head 4 is held parallel to the print surface of the print paper 3 while printing.

By establishing the printing positions in the above-stated manner, the position B and the second position B' (FIG. 3) have the same height in the direction of the feed of the print paper 3 with respect to the center A. Hence, the carriage 2 and the print head 4 are maintained parallel to the print surface of the print paper 3 at both positions without changing the set-up of the guide plate 8 and the guide plate holding units 2*c*,2*d*. Moreover, as long as the height of each position in the direction of feed of the print paper 3, with respect to the center A, is the same, the above-mentioned effect is obtained and the amount of movement of the carriage 2 and the print head 4 can be made large by selecting and setting the positions such that the displacement from one position to the other position is large.

The protrusions 2*a*,2*b* of the carriage 2 and the hole 5*b* of the adjustment lever 5*a* are provided so that the positions of carriage 2 and the print head 4 are predetermined at the above-described positions B, B' by the engagement of a protrusion 2*a*,2*b* and the hole 5*b*. Of the two positions above, the one B in which the interval between the print surface of the print paper 3 and the print head 4 is narrow is determined by the engagement of the hole 5*b* and the protrusion 2*a* and is used to execute printing on the print surface of a print paper 3 having a normal thickness (the solid line position of lever 5*a* in FIG. 3). The second position B', where the interval between the print surface of the print paper 3 and print head 4 is wide, is determined by the engagement of the hole 5*b* and the protrusion 2*b* and is used to execute printing on the print surface of a print paper 3 with a thicker-than-normal thickness (the position of broken line ever 5*a*' in FIG. 3). By using the protrusions 2*a*, 2*b* and the hole 5*b*, the selection and setting of the two positions described above can be done properly and easily.

In this manner, the carriage 2 moves to contact or retreat from the print paper 3 by rotating the decentering collar 5, provided in the carriage 2, of the printer 1 of the present embodiment and the interval between the print surface of the print paper 3 and print head 4 can be adjusted. By selecting and the setting of the two positions where the heights in the direction of feed of the print paper 3, with respect to the center of rotation A of the decentering collar 5, of the center of rotation B of the cylindrical unit 5*c*, which moves by rotation of decentering collar 5, the print head 4 can be moved to an appropriate print position without changing the orientation of the print head 4. By doing so, the distance from each part of the surface of the print head 4 facing the print paper 3 to the print surface of the print paper 3 is made equal, resulting in uniform printing quality. Moreover, by fixing the rotation of decentering collar 5*a* by the engagement of the protrusions 2*a*,2*b* of the carriage 2 with the hole 5*a* of the adjustment lever 5*a* and by setting adjustment lever 5*a* to be fixed in one of the above two positions, selection and setting of positions of the print head 4 to execute printing can be accomplished properly and easily.

The invention is not limited to the above-mentioned structure and various modifications are possible. For example, for the protrusions 2*a*, 2*b* and hole 5*b* for fixing rotation of the adjustment lever 5*a*, it is not necessary that protrusions 2*a*,2*b* be provided on the carriage 2 and the hole 5*b* be provided in the adjustment lever 5*a*. It is permissible to provide a protrusion 5*g* (FIG. 3(*a*)) on the adjustment lever 5 and holes on the carriage 2 or, alternatively, protrusions 5*h*, 5*h*' (FIG. 3(*b*)) on the adjustment lever 5*a* by widening the adjustment lever 5*a* and a single hole on the carriage 2. Moreover, although an ink jet type printer is used to describe the invention, the invention can be applied to other printers where it is necessary to have the face of the print head 4 and print paper 3 parallel to one another.

What is claimed is:

1. A printer of the type of printers capable of adjusting the interval between a print paper and a print head of the printer which prints on the print paper according to the thickness of the print paper, comprising:

a carriage holding the print head and for moving linearly back and forth along the print line of the print paper;

a guide member to guide the carriage to move linearly back and forth;

a decentering collar fitted on the external surface of the guide member in such manner that the collar is allowed to slide along and rotate on the guide member, the decentering collar holds the carriage in such manner that the decentering collar rotates within a cylindrical opening in the carriage, an axis of the decentering collar is offset by predetermined decentering amount with respect to an axis of the guide member; and a positioning member to position the decentering collar in at least one of two rotational positions by rotating on the external surface of the guide member such that heights of the shifted positions in the direction of feed the print paper are the same so that the pitch of the print head relative to the print paper is unchanged, the positioning member including a position determining member to determine a relative position between the decentering collar and the carriage, wherein adjustment of the interval between the print paper and the print head is enabled by moving the carriage toward or away from the print paper through rotation of the decentering collar around the guide member, and the shift mount of the center of rotation to hold the carriage can be determined by the position determining member.

2. The printer of claim 1, wherein the positioning member is provided in the decentering collar further comprises:

an adjustment lever attached to the decentering collar and rotating with the decentering collar.

3. The printer of claim 1, wherein the position determining member comprises engagement members which can engage with each other on opposing surfaces of the adjustment lever and the carriage.

4. The printer of claim 3, wherein the engagement members comprise protrusions and a hole on the opposing surfaces of the adjustment lever and the carriage which engage with each other.

5. The printer of claim 1, wherein the adjustment lever forms a single unit with the decentering collar.

6. A positioning mechanism for a print carriage, carrying a print head, of a printer, comprising:

a guide rod;

a decentering collar rotatably and slidably mounted on the guide rod;

the print carriage rotatably receiving, at a print head end of the print carriage, the decentering collar in an annular opening;

a guide system at an opposite end of the print carriage from the print head end; and a position setter that sets a position of the decentering collar, said decentering collar eccentrically mounted on the guide rod such that a center axis of the decentering collar moves between mirror image positions on opposite sides of a plane passing through an axis of the guide rod and parallel to a face of the print head, the position setter including a fixer that fixes the decentering collar center axis at a selected one of the mirror image positions.

7. The positioning mechanism as claimed in claim 6, wherein the guide system comprises:

a guide plate; and a pair of opposing guide plate holding units mounted to the print carriage and receiving the guide plate therebetween.

8. The positioning mechanism as claimed in claim 6, wherein said position setter further comprises a positioning lever mounted to the decentering collar and a fixer that fixes the decentering collar center axis at a selected one of the mirror image positions.

9. The positioning mechanism as claimed in claim 6, wherein the fixer comprises a pair of protrusions extending from the print carriage and a hole in the positioning lever.

10. The positioning mechanism as claimed in claim 6, wherein the fixer comprises a pair of depressions in the print carriage and a protrusion from the positioning lever extending toward the print carriage.

11. The positioning mechanism as claimed in claim 6, wherein the fixer comprises a depression in the print carriage and a pair of protrusions extending from the projection lever toward the print carriage.

12. A positioning mechanism for a print carriage, carrying a print head, of a printer, comprising:

a guide rod having a center axis;

a collar rotatably and slidably mounted to the guide rod, the print carriage rotatably receiving the collar in an annular opening at a print head end of the print carriage;

a guide plate;

an opposing pair of holding units mounted to an end of the print carriage opposite the print head end and receiving and retaining the guide plate therebetween; and a positioning lever attached to the collar at one end, the collar being eccentrically mounted on the guide rod such that a center axis of the collar is movable from a first position on one side of a plane passing through the center axis of the guide rod parallel to a print face of the print head and a second position on an opposite side of the plane, the first and second positions mirror images of one another a fixing mechanism that fixes the collar at a selected one of the first position and the second position.

13. The positioning mechanism a claimed in claim 12, wherein the fixing mechanism comprises a pair of protrusions extending from the print carriage and a hole in the positioning lever.

14. The positioning mechanism as claimed in claim 13, wherein one protrusion of the pair of protrusions defines the first position and the other protrusion of the pair of protrusions defines the second position.

15. The positioning mechanism as claimed in claim 12, wherein the fixing mechanism comprises a pair of depressions in the print carriage and a protrusion from the positioning lever extending toward the print carriage.

16. The positioning mechanism as claimed in claim 15, wherein one depression of the pair of depressions corresponds to the first position and the other depression of the pair of depression corresponds to the second position.

17. The positioning mechanism as claimed in claim 12, wherein the fixing mechanism comprises a depression in the print carriage and a pair of protrusions extending from the projection lever toward the print carriage.

18. The positioning mechanism as claimed in claim 17, wherein one protrusion of the pair of protrusions defines the first position and the other protrusion of the pair of protrusions defines the second position.

* * * * *